US008995862B2

(12) United States Patent
Mizukoshi et al.

(10) Patent No.: US 8,995,862 B2
(45) Date of Patent: Mar. 31, 2015

(54) IMAGE FORMING APPARATUS

(71) Applicant: Canon Kabushiki Kaisha, Tokyo (JP)

(72) Inventors: Shunsuke Mizukoshi, Yokohama (JP); Shuichi Tetsuno, Kawasaki (JP); Takahiro Ikeda, Saitama (JP); Yuta Isobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/065,992

(22) Filed: Oct. 29, 2013

(65) Prior Publication Data

US 2014/0119764 A1 May 1, 2014

(30) Foreign Application Priority Data

Nov. 1, 2012 (JP) ..... 2012-242102
Oct. 23, 2013 (JP) ..... 2013-219954

(51) Int. Cl.
*G03G 15/00* (2006.01)
*G03G 21/00* (2006.01)

(52) U.S. Cl.
CPC ..... *G03G 21/0011* (2013.01); *G03G 15/50* (2013.01)
USPC ..... 399/71

(58) Field of Classification Search
USPC ..... 399/71
See application file for complete search history.

(56) References Cited

U.S. PATENT DOCUMENTS

| | | | | |
|---|---|---|---|---|
| 5,692,232 | A * | 11/1997 | Okano et al. | 399/53 |
| 5,797,063 | A * | 8/1998 | Umezawa et al. | 399/34 |
| 7,395,004 | B2 * | 7/2008 | Nishikawa | 399/71 |
| 8,472,853 | B2 | 6/2013 | Akamatsu et al. | |
| 2003/0180064 | A1 * | 9/2003 | Hisakuni | 399/71 |
| 2007/0242968 | A1 * | 10/2007 | Chiba | 399/66 |
| 2012/0163837 | A1 * | 6/2012 | Tomita et al. | 399/13 |
| 2013/0336670 | A1 | 12/2013 | Ikeda et al. | |
| 2014/0050499 | A1 * | 2/2014 | Tetsuno et al. | 399/71 |
| 2014/0153955 | A1 * | 6/2014 | Yamashita et al. | |
| 2014/0294414 | A1 * | 10/2014 | Minato | 399/101 |

FOREIGN PATENT DOCUMENTS

JP 2005-165218 A 6/2005

* cited by examiner

*Primary Examiner* — Rodney Fuller
(74) *Attorney, Agent, or Firm* — Fitzpatrick, Cella, Harper & Scinto

(57) ABSTRACT

An image forming apparatus includes: at least one image bearing member; a developing device for forming a developer image by developing a latent image formed on a surface of the image bearing member; a cleaning device, including a cleaning blade for collecting a developer on the image bearing member; a discriminating portion for discriminating whether or not a cleaning sequence in which an amount of the developer to be conveyed to the cleaning device is adjusted is to be performed; and a stop detecting portion for detecting the stop of an operation of the image forming apparatus. When the operation of the image forming apparatus is resumed after the stop detecting means detects stop of the operation of the image forming apparatus, the discriminating means discriminates, before the image bearing member is operated, whether or not the cleaning sequence is to be performed.

14 Claims, 13 Drawing Sheets

IMAGE FORMING APPARATUS

FIELD OF THE INVENTION AND RELATED ART

The present invention relates to an image forming apparatus.

In a conventional image forming apparatus such as a copying machine or a printer, an electrostatic recording type, an electrophotographic recording type, or the like is frequently used. As one of these types, a method (type) in which a toner image (developer image) formed on a photosensitive drum (image bearing member) is transferred onto a recording material such as a sheet or the like by an electrostatic force acting between the photosensitive drum and a transfer roller as a transfer means has been known.

However, in some cases, the toner image cannot be completely transferred from the photosensitive drum onto the recording material, and after the toner image is transferred, the toner remains in a small amount on the photosensitive drum. In the case where a method in which the photosensitive drum is electrically charged by bringing a charging device into contact with the photosensitive drum, there is a fear that this transfer residual toner is deposited on the charging device to cause improper charging, thus resulting in generation of vertical stripe and image density non-uniformity. Therefore, a cleaning method in which a cleaning blade consisting of an elastic member is contacted to the photosensitive drum to scrape off and collect the transfer residual toner has been used. In this case, in order to prevent the toner from moving from the photosensitive drum onto the transfer roller, a voltage of an opposite polarity to a voltage polarity during image formation is applied to the transfer roller (Japanese Laid-Open Patent Application (JP-A) 2005-165218).

However, there is the case, such as the case where a paper jam occurs during the image formation, where the toner which has not been transferred by the transfer roller remains in a large amount on the photosensitive drum when the image forming apparatus is stopped due to an emergency. When the paper jam is cleared from such a state and then an operation is restored, the toner remaining on the photosensitive drum is to be conveyed to the cleaning blade with rotation of the photosensitive drum. In this case, in a state in which particularly a print ratio of the toner image remaining on the photosensitive drum is high, powder pressure of the conveyed toner continuously acts on the cleaning blade. As a result, an end of the cleaning blade is pressed against the photosensitive drum toward a downstream direction with respect to a rotational direction of the photosensitive drum, so that there is a fear that the toner slips through the cleaning blade. In the case where the slip of the toner through the cleaning blade occurs, the toner is deposited on the charging device, so that the charging device cannot uniformly charge the photosensitive drum to a predetermined potential in some cases. As a result, image defect such as vertical stripes or image density non-uniformity is generated. Therefore, it would be considered that a cleaning sequence in which the toner is conveyed slowly to the cleaning blade little by little is performed.

On the other hand, in the case where the operation of the image forming apparatus is stopped due to an emergency, there is also the case where almost no toner is present on the photosensitive drum. In such a case, the toner in a large amount does not remain on the photosensitive drum, and therefore there is no fear that the toner slips through the cleaning blade. Nevertheless, also in such a case, when the cleaning sequence is similarly performed, it would be considered that a restoring time of a restoring operation after the emergency stop becomes long more than necessary. Therefore, in the present invention, study has been made in order to solve these problems.

SUMMARY OF THE INVENTION

A principal object of the present invention is to provide an image forming apparatus, for performing a cleaning sequence, capable of reducing a restoring time of a restoring operation after an image forming operation is stopped.

According to an aspect of the present invention, there is provided an image forming apparatus comprising: at least one image bearing member; a developing device for forming a developer image by developing a latent image formed on a surface of the image bearing member; a cleaning device, including a cleaning blade which is in contact with the image bearing member and which has elasticity, for collecting a developer on the image bearing member; discriminating means for discriminating whether or not a cleaning sequence in which an amount of the developer to be conveyed to the cleaning device is adjusted is to be performed; and stop detecting means for detecting stop of an operation of the image forming apparatus, wherein when the operation of the image forming apparatus is resumed after the stop detecting means detects the stop of the operation of the image forming apparatus, the discriminating means discriminates, before the image bearing member is operated, whether or not the cleaning sequence is to be performed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

With reference to the drawings, embodiments of the present invention will be described below. However, dimensions, materials, shapes and relative arrangement of constituent elements described in the following embodiments should be appropriately changed depending on structure and various conditions of devices (apparatuses) to which the present invention is to be applied, and therefore the scope of the present invention is not intended to be limited to the following embodiments.

Embodiment 1

<Structure of Image Forming Apparatus>

Figure 1:
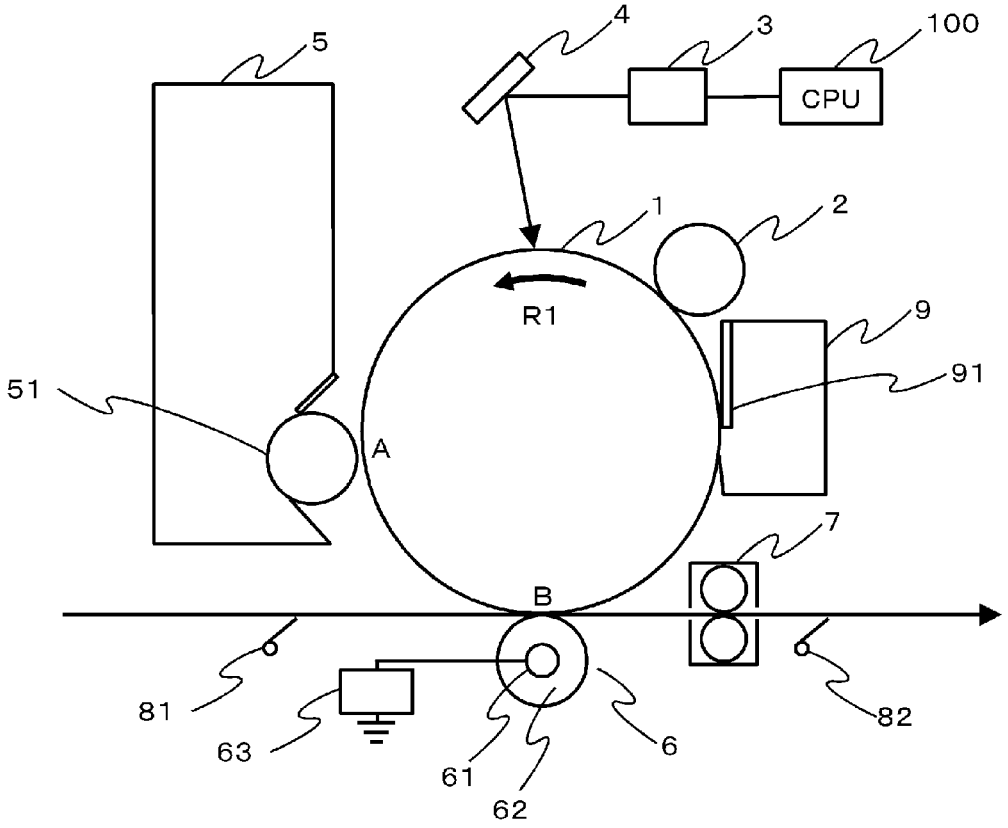
FIG. 1 is a schematic sectional view showing a structure of an image forming apparatus in Embodiment 1.

With reference to FIG. 1, a structure of an image forming apparatus in Embodiment 1 will be described. FIG. 1 is a schematic sectional view showing the structure of the image forming apparatus in this embodiment. This image forming apparatus includes a controller (controlling device or CPU) 100 for transferring various pieces of electrical information between the controller 100 and a host device and for effecting integrated control of an image forming operation of the image forming apparatus in accordance with a predetermined control program or a predetermined look-up table. Further, the image forming apparatus forms an image on a recording material P having a sheet shape, on the basis of an electric image signal inputted from the host device into the controller 100. Incidentally, examples of the host device include an image reader (original image reading device), a personal computer, a facsimile machine and the like.

As shown in FIG. 1, the image forming apparatus in this embodiment includes a photosensitive drum 1 as an image bearing member, a charging roller 2 as a charging means, an exposure device as an exposure means, a developing device 5, a transfer roller 6 as a transfer means (cleaning member), a fixing device 7 and a cleaning device 9. The cleaning device 9 includes a cleaning blade 91 which is contacted to the photosensitive drum 1 and which has elasticity.

The develop 1 is 24 mm in diameter and is constituted by a charge-transporting layer, a charge-generating layer, an undercoat layer and an aluminum cylinder. Further, to the photosensitive drum 1, a voltage of −100 V is applied by the charging roller 2. The transfer roller 6 is rotatably provided, and is pressed toward the photosensitive drum 1 so that the recording material P is nip-conveyed and a toner image as a developer image is transferred onto the recording material P. Further, the transfer roller 6 is 12.5 mm in diameter and 39 mm in circumference, and is constituted by an electroconductive core metal 61 of 5 mm in diameter and an urethane foam layer 62. Further, with the transfer roller 6, a voltage application means 63 for applying a voltage (transfer bias) to the transfer roller 6 is connected. The voltage to be applied to the transfer roller 6 by the voltage application means 63 is controlled by the controller (control portion) 100. By effecting control such that the voltage to be applied to the transfer roller 6 is changed, the toner is transferable between the photosensitive drum 1 and the transfer roller 6.

The photosensitive drum 1 is electrically charged uniformly to a predetermined polarity and a predetermined potential by the charging roller 2 while being rotated in an arrow R1 direction in FIG. 1 at a rotational speed of 100 mm/sec. Then, the surface of the photosensitive drum 1 (image bearing member) is exposed via a reflection mirror 4, to a laser beam emitted from the exposure device 3 controlled by the controller 100, so that an electrostatic latent image is formed on the photosensitive drum 1. Of surface potentials of the photosensitive drum 1, the surface potential at a portion where the electrostatic latent image is formed is −100 V, and the surface potential at a portion where the electrostatic latent image is not formed is −500 V.

Further, in an example of this embodiment, the developing device 5 contains a negatively chargeable magnetic one-component toner, and includes a developing roller 51 as a rotatable developer carrying member. The developing roller 51 visualizes the electrostatic latent image by supplying the toner onto the photosensitive drum 1, thus forming the toner image as the developer image. Here, on the photosensitive drum 1, a position where the developing roller 51 is closest to the photosensitive drum 1 and the toner is to be supplied onto the photosensitive drum 1 is a developing position A.

The toner image formed on the photosensitive drum 1 is transferred onto the recording material P by the transfer roller 6. Here, on the photosensitive drum 1, a position where the toner image is to be transferred onto the recording material P is a transfer position B.

The recording material P on which the toner image is transferred is then sent to the fixing device 7. By the fixing device 7, the toner image on the recording material P is pressed and heated to be fixed on the recording material P, thus constituting a final image.

Further, the image forming apparatus in this embodiment includes a recording material conveyance detecting means (registration sensor) 81 provided upstream of the transfer roller 6 with respect to a conveyance direction of the recording material P and a recording material conveyance detecting means (outer sheet discharging sensor) 82 provided downstream of the fixing device 7 with respect to the conveyance direction of the recording material P. The registration sensor 81 is a sensor for aligning a position of the toner image formed on the photosensitive drum 1 with a position of the recording material P. Further, the outer sheet discharging sensor 82 is a sensor for discriminating whether or not the recording material P is discharged to an outside of the image forming apparatus.

After the registration sensor 81 detects the recording material P, in the case where the recording material P is not detected by the outer sheet discharging sensor 82 until a lapse of a certain time determined in advance, discrimination of detection such that improper conveyance of the recording material P is caused between the registration sensor 81 and the outer sheet discharging sensor 82 is made. Further, in the case where the outer sheet discharging sensor 82 is not turned off (e.g., the recording material P is continuously detected) after a further lapse of a predetermined certain time from the detection of the recording material P by the outer sheet discharging sensor 82, discrimination of detection such that the improper conveyance of the recording material P is caused in the fixing device 7 is made. That is, in this embodiment, the registration sensor 81 and the outer sheet discharging sensor 82 perform the function as a stop detecting means for detecting stop of the image forming operation. Pieces of information from these sensors are processed by the controller 100.

(State of Toner During Emergency Stop)

Figure 2:
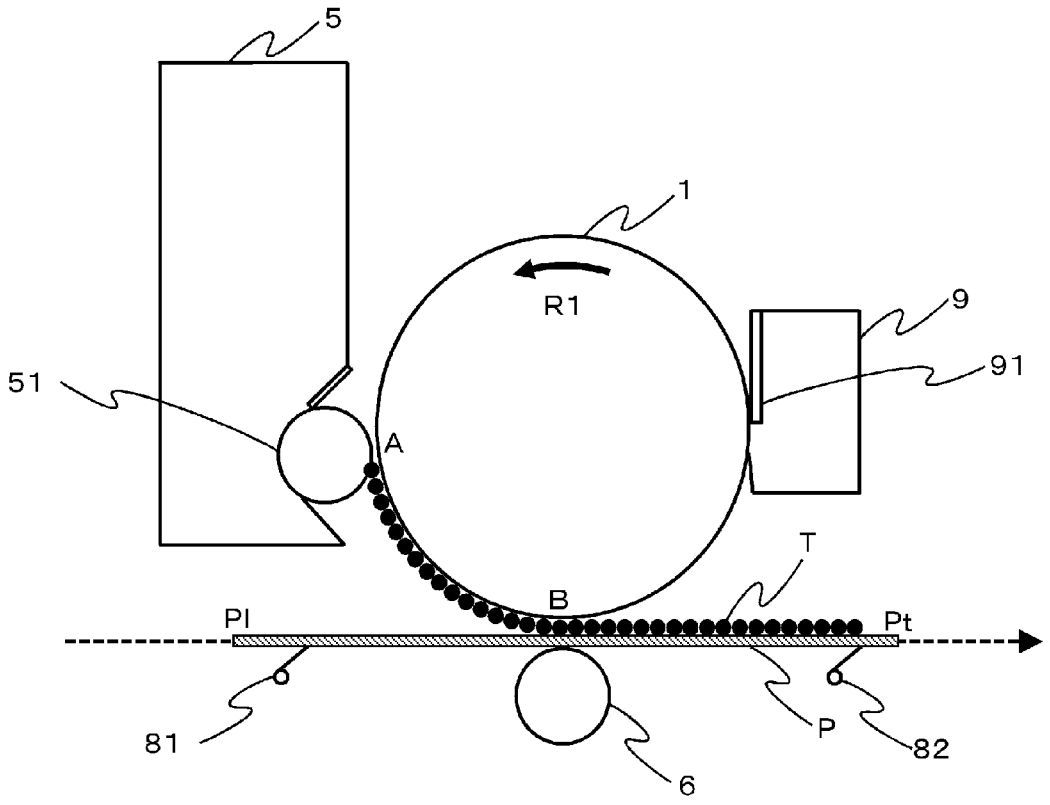
FIG. 2 is a schematic sectional view showing an example of a toner presence state in the case where the image forming apparatus is stopped due to an emergency during an image forming operation.

FIG. 2 is a schematic sectional view showing an example of a toner presence state in the case where the image forming apparatus is stopped due to an emergency during the image forming operation. Incidentally, in this embodiment, as shown in FIG. 1, the photosensitive drum 1 and the transfer roller 6 are naturally in contact with each other, but for convenience for showing the toner presence state, the photosensitive drum 1 and the transfer roller 6 were illustrated in a spaced state in FIG. 2. Incidentally, for the same reason, also in FIGS. 3, 4, 6, 7, 8 and 12, the photosensitive drum 1 and the transfer roller 6 were illustrated in the spaced state. Here, as shown in FIG. 2, a leading end and a trailing end of the recording material P with respect to the conveyance direction of the recording material P is taken as Pt and Pl, respectively.

Further, black dots in FIG. 2 represent a toner T, and of the toner image on the photosensitive drum 1, a trailing end is located in the developing position A, and a leading end is located in the transfer position B.

Incidentally, in this embodiment, as the case where the image forming apparatus is stopped due to the emergency, the case where the improper conveyance of the recording material P is detected was shown. However, the case of the emergency stop is not limited thereto may also be the case where electric power is not supplied, the case where an increase in torque due to improper mesh of gears (not shown), and the like case. Also in the cases of the emergency stop due to these factors, the constitution of the present invention can be applied.

(Restoring Operation During Emergency Stop)

Figure 3:
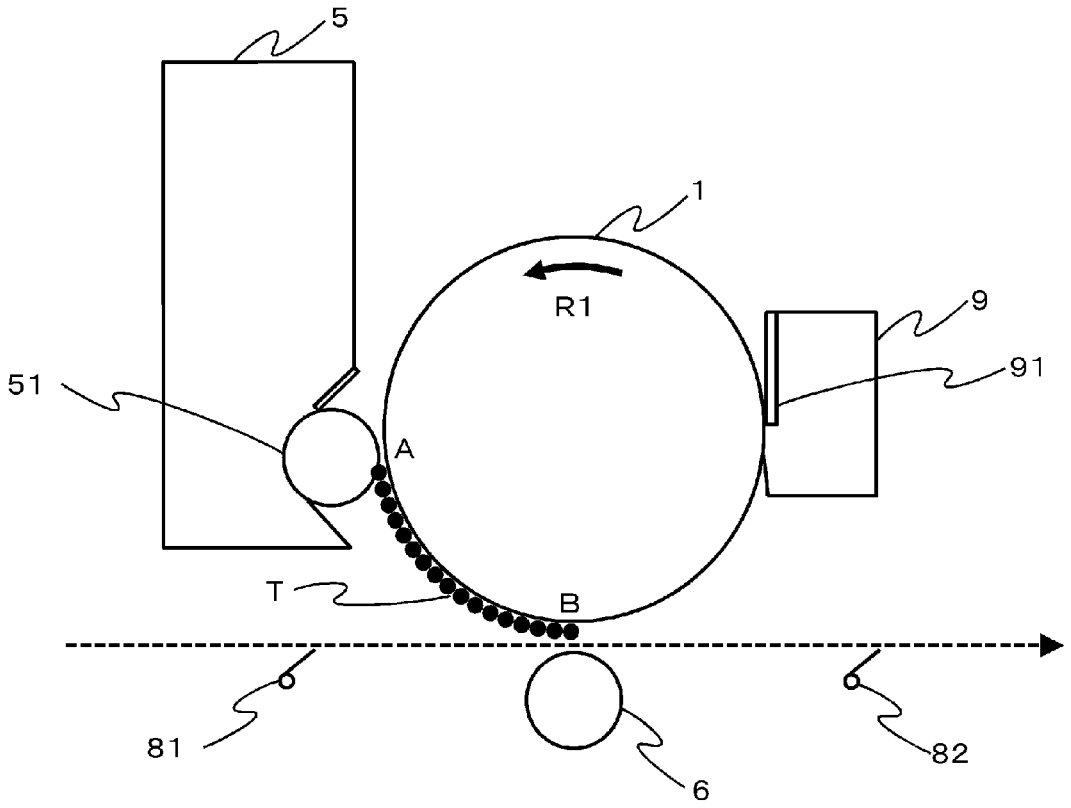
FIG. 3 is a schematic sectional view showing the toner presence state when a recording material is removed after a state shown in FIG. 2.
Figure 4:
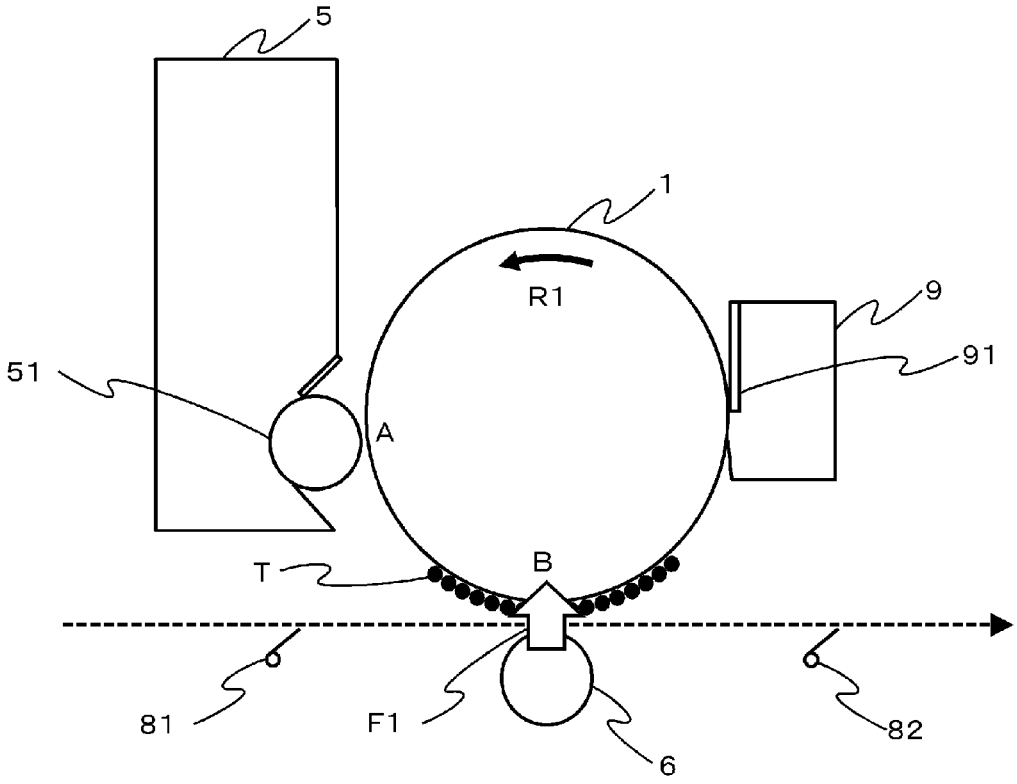
FIG. 4 is a schematic sectional view showing the toner presence state in a conventional restoring operation.

FIG. 3 shows a toner presence state when the recording material P is discharged (removed) by a user's hand after a state shown in FIG. 2. A restoring operation for resuming the operation of the image forming apparatus from this state will be described with reference to FIG. 4. FIG. 4 is a schematic view showing a toner presence state in a conventional restoring operation.

A conventional image forming apparatus capable of executing a restoring operation such that a toner T remaining (present) on the photosensitive drum 1 is, after the image forming operation is stopped due to an emergency conveyed and removed no the cleaning device 9 by rotating the photosensitive drum 1. In this restoring operation, by applying a voltage, to the transfer roller 6, of an opposite polarity to the polarity of the transfer voltage during the image formation, the toner T remaining on the photosensitive drum 1 is conveyed to the cleaning device 9 by the rotation of the photosensitive drum 1 without being transferred onto the transfer roller 6. Specifically, the transfer bias of −1500 V is applied to the transfer roller 6, and the surface potential at a portion where the toner image is formed on the photosensitive drum 1 is −100 V. Further, most of the toner T is negatively charged, so that an electrostatic force acts on the toner T in an arrow F1 direction of FIG. 4. For that reason, the toner T remaining on the photosensitive drum 1 is conveyed to the cleaning device 9 by the rotation of the photosensitive drum 1 without being transferred onto the transfer roller 6.

However, in such a constitution, the toner in a large amount is conveyed at once to the cleaning device 9, and therefore there was a fear that the end of the cleaning blade 91 is caught by the photosensitive drum 1 under toner pressure to generate slip of the toner through the cleaning blade 91. As a result, there was a fear that image density non-uniformity is generated by deposition, on the charging roller 2, of the toner which has slipped through the cleaning blade 91. Therefore, in the restoring operation, a toner cleaning sequence such that a part of the toner remaining on the photosensitive drum 1 is transferred (collected) onto the transfer roller 6 at the transfer position B and then is transferred back onto the photosensitive drum 1 when the toner reaches again the transfer position B by the rotation of the transfer roller 6 has been known.

Here, a relationship between an amount of the toner conveyed to the cleaning blade 91 on the photosensitive drum 1 and a slip state of the toner through the cleaning blade 91 (slip-through state), i.e., a tolerance amount of the toner conveyed at once to the cleaning blade 91 will be described. The voltage applied to the transfer roller 6 is changed from +300 V to +1500 V, and then the slip-through state at each voltage is shown in Table 1 below. In Table 1, the case where slip-through the toner is generated and thus image defect is observed is evaluated as "x", and the case where no slip-through of the toner is generated is evaluated as "○". Further, the case where the slip-through of the toner is observed but the image defect is not observed at that time is evaluated as "Δ". In the following description, a whole-surface toner image (solid toner image) is formed on the surface of the photosensitive drum 1, and at this time, the toner amount between the developing position A and the transfer position B on the photosensitive drum 1 is taken as 100%.

TABLE 1

| AV*1 (V) | +300 | +600 | +1000 | +1500 |
|---|---|---|---|---|
| TA*2 (%) | 75 | 50 | 25 | 5 |
| STS*3 | Δ | ○ | ○ | ○ |

*1"AV" represents the applied voltage (V) to the transfer roller.
*2"TA" represents the toner amount (%) on the photosensitive drum.
*3"STS" represents the slip-through state of the toner.

As is understood from Table 1, in the case where the toner in the amount of 75% remains on the photosensitive drum 1 (i.e., in the case where the toner in the amount of 25% is transferred onto the transfer roller 6), the slip-through of the toner is generated. At that time, the degree of the slip-through of the toner is not to the extent that the image defect can be observed, but in the case where the slip-through of the toner is generated plural times, a contaminant on the charging roller 2 is gradually accumulated, and there is a fear that the image defect is generated at some time. For that reason, it is preferable that the slip-through of the toner is not generated. Therefore, it is understood that in the case where the toner amount (developer amount) remaining on the photosensitive drum 1 is 100%, the amount of the toner transferred onto the transfer roller 6 may preferably be more than 25%. Further, in the case where the toner in the amount of 50% remains no the photosensitive drum 1 (i.e., in the case where the toner in the amount of 50% is transferred onto the transfer roller 6), the slip-through of the toner is not generated. That is, in the constitution in this embodiment, the tolerance amount of the toner conveyed at once to the cleaning blade 91 is 50%. Accordingly, the amount of the toner conveyed at once to the cleaning blade 91 is made 50% or less on the basis of the toner amount in an original state, whereby the degree of the image defect due to the slip-through of the toner can be reduced.

(Cleaning Sequence)

Figure 5:
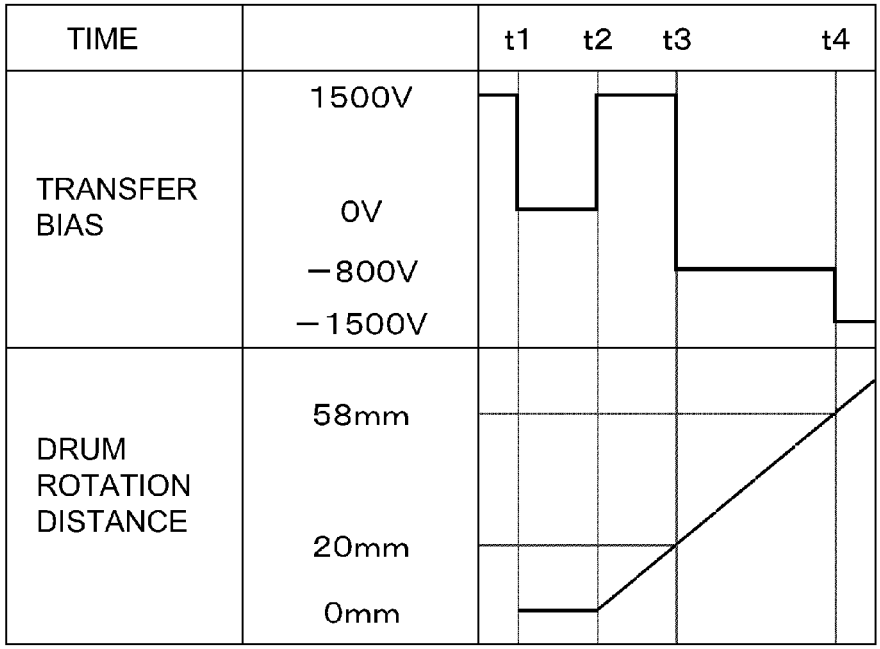
FIG. 5 is a timing chart of a cleaning sequence in Embodiment 1.
Figure 6:
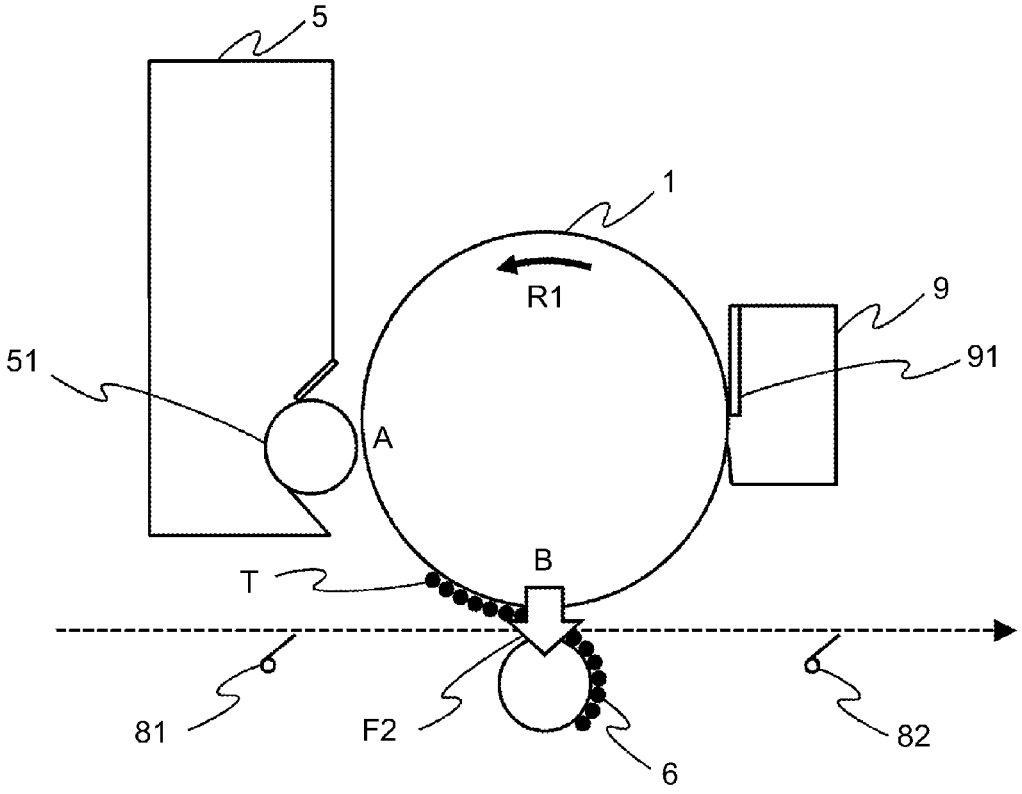
FIGS. 6, 7 and 8 are schematic sectional views each showing the toner presence state when the cleaning sequence in Embodiment 1 is performed.
Figure 7:
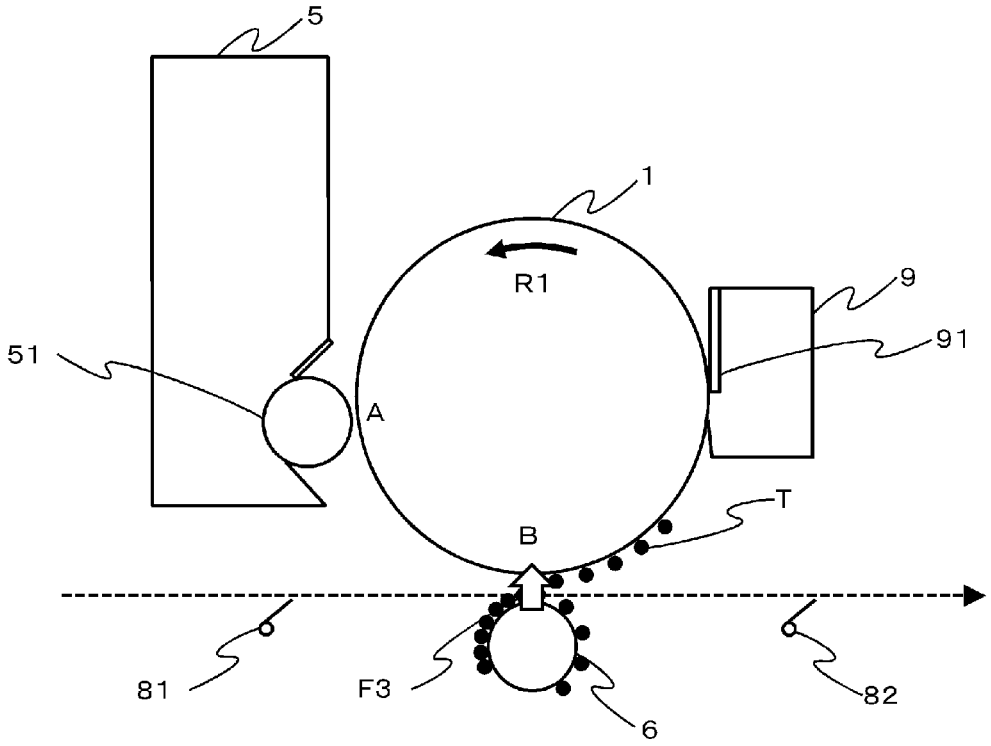
Figure 8:
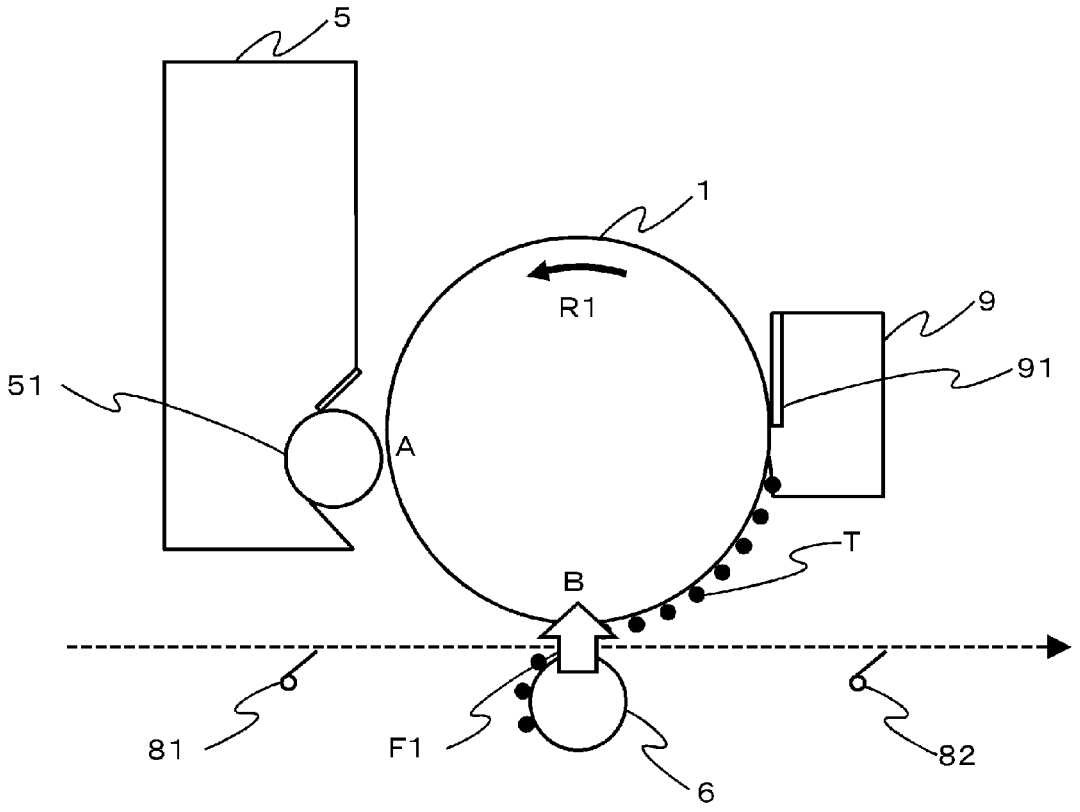

Next, with reference to FIGS. 5 to 7, the toner cleaning sequence in which the amount of the toner conveyed to the cleaning device 9 is adjusted will be described. FIG. 5 is a timing chart of the cleaning sequence. FIGS. 6 to 8 are schematic views each showing the toner presence state when the cleaning sequence in this embodiment is performed.

As shown in FIG. 5, timing when the image forming operation is stopped due to the emergency is t1. After the emergency stop, timing when drive of the photosensitive drum 1 is started in the restoring operation is t2. At this timing t2, to the transfer roller 6, the transfer bias of +1500 V is applied. Then, the transfer bias is switched to −800 V at timing t3. Then, at timing t4, the transfer bias is changed to −1500 V.

Further, details of the cleaning sequence will be described with reference to FIGS. 5 to 8. A state from the timing t2 to the timing t3 is shown in FIG. 6. As described above, during the state, the transfer bias applied to the transfer roller 6 is +1500 V which is the same as the transfer bias during image formation, and the electrostatic force acts on the toner T in an arrow F2 direction. For this reason, in the state from t2 to t3, the toner T reaching the transfer position B by the rotation of the photosensitive drum 1 is successively attracted to and collected by the transfer roller 6 capable of collecting the toner in contact with the photosensitive drum 1 in a rotatable manner.

Here, a circumference (perimeter) of the photosensitive drum 1 from the developing position A to the transfer position B is 20 mm, and therefore in order to collect the toner image present at the developing position A during emergency stop to a trailing end of the toner image by the transfer roller 6, there is a need to rotate the photosensitive drum 1 by 20 mm. Therefore, the timing when the photosensitive drum 1 is just rotated by 20 mm from the timing t2 is taken as t3, and at this timing, the transfer bias was switched to −800 V.

Then, a state from the timing t3 to timing t4 is shown in FIG. 7. As described above, the transfer bias applied during this state is −800 V. This transfer bias of −800 V is a bias controlled so that 50% of the toner T collected by the transfer roller 6 is transferred onto the photosensitive drum 1 and remaining 50% of the collected toner remains on the photosensitive drum 1.

Incidentally, at the timing t3, the trailing end of the toner image is located in the transfer position B. For that reason, in order to move the toner image trailing end again to the transfer position B, from the timing t3, there is a need to rotate the transfer roller 6 through just one full circumference.

Here, the circumference of the transfer roller 6 is 39 mm, and the transfer roller 6 is rotated by the rotation of the photosensitive drum 1. For that reason, during one rotation (one full turn) of the transfer roller 6, the photosensitive drum 1 is rotated by 39 mm which is the same as the circumference of the transfer roller 6. For this reason, the timing chart may be considered simply in terms of a rotation distance of the photosensitive drum 1. Therefore, timing when the photosensitive drum 1 is rotated by 39 mm from the timing t3, i.e., timing when the photosensitive drum 1 is rotated by 58 mm from the timing t2 is taken as t4, and at the timing t4, the transfer bias was switched to −1500 V.

Further, a state of the timing t4 and later is shown in FIG. 8. In the state of the timing t4 and later, an electrostatic force F1 which is directed in the same direction as an arrow F3 direction of the electrostatic force acting from t3 to t4 and which is larger than the electrostatic force acts on the toner T. As a result, all the toner T once collected on the transfer roller 6 is moved back again onto the photosensitive drum 1.

Here, the case where the circumference (20 mm) of the photosensitive drum 1 from the developing position A to the transfer position B is shorter than the circumference (39 mm) of the transfer roller 6 is shown, but the case where the circumference of the transfer roller 6 is shorter than the circumference of the photosensitive drum 1 from the developing position A to the transfer position B may also be employed. However, in this case, there is a need to decrease the amount of the toner to be moved back from the transfer roller 6 to the photosensitive drum 1 and to increase the number of rotation of the transfer roller 6 correspondingly.

Further, in the above-described cleaning sequence, almost all of the toner remaining on the photosensitive drum 1 during emergency stop is once transferred onto the transfer roller 6 and then is returned onto the photosensitive drum 1, but a part of the toner remaining on the photosensitive drum 1 may also be once transferred onto the transfer roller 6.

Specifically, e.g., the transfer bias to be applied between t2 and t3 is not set at +1500 V which is the transfer bias during image formation, but is set at +600 V smaller than the transfer bias of +1500 V. The amount of the toner to be transferred onto the transfer roller 6 is 50% of the toner remaining on the photosensitive drum 1 during emergency stop, and the toner in a remaining amount of 50% is conveyed as it is to the cleaning device 9 by the rotation of the rotation of the photosensitive drum 1 without being transferred onto the transfer roller 6.

Figure 9:
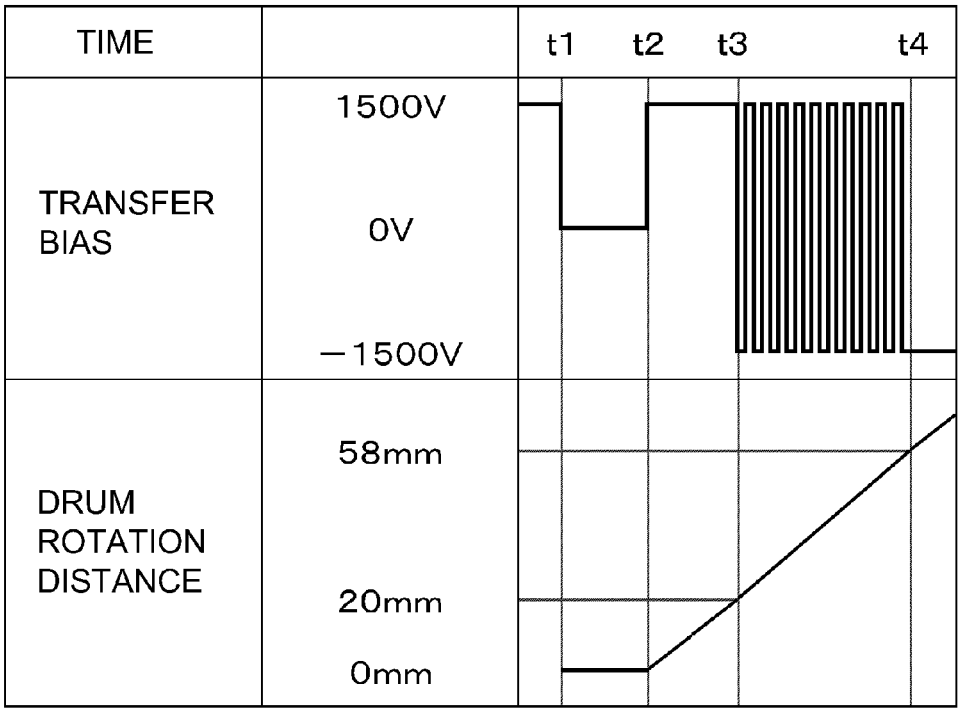
FIG. 9 is a timing chart of the cleaning sequence in Embodiment 1.

Further, in the above, the cleaning sequence in which a part of the toner remaining on the photosensitive drum 1 during emergency stop is once transferred onto the transfer roller 6 by adjusting a magnitude of the transfer bias was described. However, the present invention is not limited thereto, but in the cleaning sequence, control of movement amount of the toner between the photosensitive drum 1 and the transfer roller 6 may also be effected by finely changing alternately the transfer bias polarity. In the following, by using a timing chart of FIG. 9, details of the cleaning sequence in this case will be described. The timings t1 to t4 are the same as those described above. FIG. 9 is the timing chart of the cleaning sequence in this embodiment.

Most of the toner T is negatively charged, and therefore when the transfer bias of −1500 V is applied to the transfer roller 6, the electrostatic force acts in a direction from the transfer roller 6 toward the photosensitive drum 1. On the other hand, when the transfer bias of +1500 V is applied to the transfer roller 6, the electrostatic force acts in a direction from the photosensitive drum 1 toward the transfer roller 6.

Therefore, by finely applying alternately the transfer bias of −1500 V and +1500 V to the transfer roller 6, the toner remaining on the photosensitive drum 1 during emergency stop with no gap with respect to the rotation direction of the photosensitive drum 1 is placed in an intermittent state such that a remaining portion (presence portion) and a no-remaining portion (absence portion) of the toner are present on the photosensitive drum 1, so that the toner is intermittently conveyed to the cleaning device 9.

In the case where the toner is intermittently conveyed to the cleaning device 9 in this way, the pressure of the toner T is applied to the remaining of the toner T on the photosensitive drum 1 but is not applied to the non-remaining of the toner T. For that reason, the end of the cleaning blade 91 is released from the toner pressure before being caught by the photosensitive drum 1, due to the toner pressure, with respect to the rotational direction. As a result, it is possible to reduce the degree of the slip-through of the toner.

Here, from t3 to t4, by changing a frequency of the transfer bias, a generation status of the image density non-uniformity due to the slip-through of the toner in the case where a circumferential spacing of the toner transferred at once onto the cleaning device 9 is changed is shown in Table 2.

TABLE 2

| FR*1 (Hz) | O (CE*2) | 10 | 25 | 50 |
|---|---|---|---|---|
| CL*3 (mm) | 20 | 5 | 2 | 1 |
| SL*4 | x | Δ | ○ | ○ |

*1"FR" represents the frequency (Hz).

*2"CE" represents a comparison example.

*3"CL" represents a circumferential length (mm) of the toner continuously present on the photosensitive drum.

*4"SL" represents a generation state of the slip-through of the toner. "x" represents the case where the slip-through of the toner was generated. "Δ" represents the case where the slip-through of the toner was slightly generated. "○" represents the case where no slip-through of the toner was generated.

At first, during printing of an image (solid black image) having a very high print ratio, the image forming operation is intentionally stopped due to an emergency in midstream. At this time, a state in which the toner continuously remains on the surface of the photosensitive drum 1, in a region between the developing position A to the transfer position B, with no gap with respect to the circumferential direction of the photosensitive drum 1 is created. From this state, the transfer bias of −1500 V and +1500 V are alternately applied to the transfer roller 6.

In the case where the transfer bias of −1500 V is continuously applied to the transfer roller 6 (i.e., in the case where the frequency is 0), all of the toner remaining on the photosensitive drum 1 is to be conveyed to the cleaning blade 91 without being collected by the transfer roller 6. That is, the toner in a circumferential length of 20 mm present continuously on the photosensitive drum 1 is conveyed to the cleaning blade 91. In this case, the toner pressure is continuously applied to the cleaning blade without interruption, so that the end of the cleaning blade 91 is to be caught by the photosensitive drum 1 with respect to the rotational direction of the photosensitive drum 1. As a result, it was configured that the slip-through of the toner is generated.

Further, in the case where the frequency was 10 Hz, the circumferential length of the toner continuously remaining and present on the photosensitive drum 1 was 5 mm. That is, the toner in the circumferential length of 5 mm is conveyed continuously to the cleaning blade 91, and then the toner in a subsequent circumferential length of 5 mm is conveyed to the cleaning blade 91 at an interval of 5 mm. Also in such a case, the circumferential of the toner continuously conveyed on the photosensitive drum 1 is long, and therefore the toner pressure is continuously applied to the cleaning blade 91, so that it was confirmed that the slip-through of the toner is generated slightly.

In the case where the frequency was 25 Hz, the circumferential length of the toner continuously remaining and present on the photosensitive drum 1 was 2 mm. That is, the toner in the circumferential length of 2 mm is conveyed continuously to the cleaning blade 91, and then the toner in a subsequent circumferential length of 2 mm is conveyed to the cleaning blade 91 at an interval of 2 mm. In this case, the slip-through of the toner is not generated. This is because before the end of the cleaning blade 91 is caught by the photosensitive drum 1 due to the toner pressure with respect to the rotational direction of the photosensitive drum 1, the non-remaining portion (absence portion) of the toner on the surface of the photosensitive drum 1 reaches the cleaning blade 91 to be released from the toner pressure. Further, similarly also in the case where the frequency of 50 Hz, the slip-through of the toner was not generated.

(Restoring Operation after the Emergency Stop of Image Forming Operation in Embodiment 1)

Figure 10:
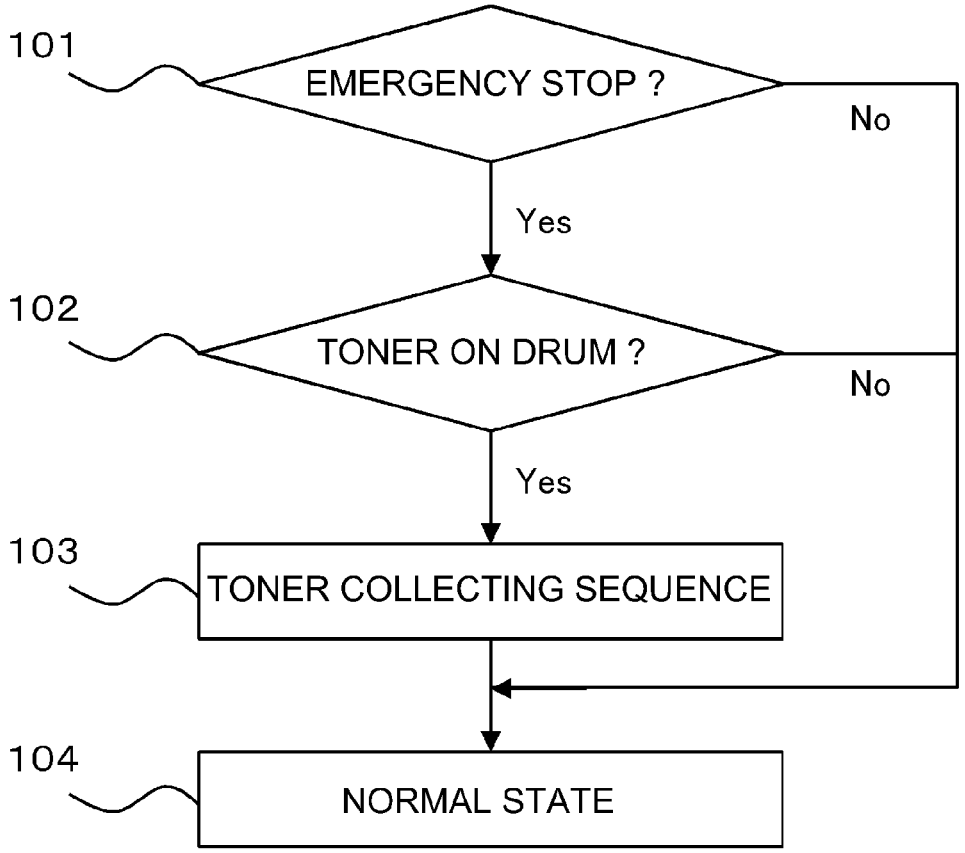
FIG. 10 is a flowchart of a restoring operation in Embodiment 1.

Next, with reference to FIG. 10, a restoring operation, as a characteristic constitution in this embodiment, after the emergency stop of the image forming operation will be described. FIG. 10 is a flowchart of the image forming apparatus after the emergency stop in this embodiment.

In the case where the image forming apparatus is stopped due to the emergency (Yes of S101), the presence of the toner on the photosensitive drum 1 is detected by a developer detecting means (not shown) provided in the controller 100 (S102). Here, the developer detecting means includes not only a means for directly detecting the presence or absence of the developer on the photosensitive drum 1 by an optical sensor but also a means for predicting the presence or absence of the developer on the photosensitive drum 1 on the basis of a movement distance of the photosensitive drum 1 described later and a means for predicting the presence or absence of the developer on the photosensitive drum 1 on the basis of image data. In the case where the presence of the toner on the photosensitive drum 1 is detected (Yes of S102), a toner cleaning sequence is executed (S103), and then, the image forming apparatus is placed in a normal state (S104). Incidentally, in the case where the image forming apparatus is not stopped due to the emergency (No of S101) or in the case where the image forming apparatus is stopped due to the emergency but there is no toner present on the photosensitive drum 1 (No of S102), the image forming apparatus is thereafter placed in the normal state (S104).

As described above, in this embodiment, only in the case where the image forming apparatus is stopped due to the emergency and the toner is present on the photosensitive drum 1, the above-described cleaning sequence is executed. The image forming apparatus in this embodiment includes a discriminating means for discriminating, on the basis of a detection result of the developer detecting means, whether or not the cleaning sequence should be performed. Incidentally, in this embodiment, the discriminating means is provided in the controller 100. A detecting method of whether or not the toner is present on the photosensitive drum 1 will be described below.

Figure 11:
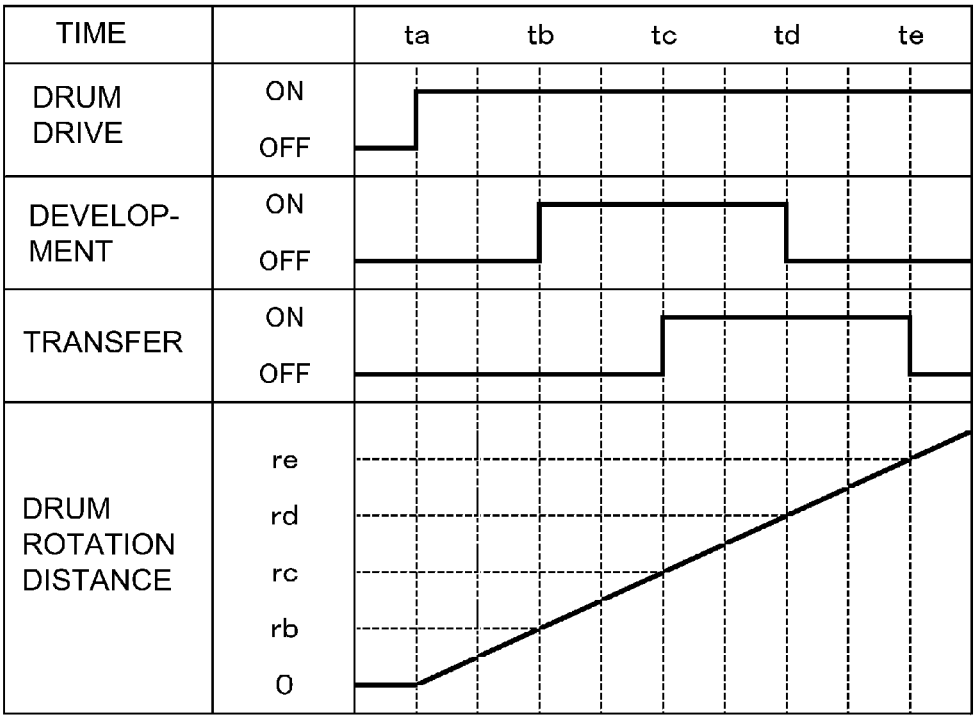
FIG. 11 is a timing chart of an image forming operation in Embodiment 1.

FIG. 11 is a timing chart of development and transfer during the image formation. As shown in FIG. 11, timing when the rotation of the photosensitive drum 1 is started is taken as Ta. Further, timing when supply of the toner from the developing roller 51 to the photosensitive drum 1 is started (development start time) is taken as tb. Further, timing when transfer of the toner image from the photosensitive drum 1 onto the recording material P is started is taken as tc. Further, timing when the supply of the toner from the developing device to the photosensitive drum 1 is ended is taken as td. Finally, timing when the transfer of the toner from the photosensitive drum 1 onto the recording material P is ended (transfer end time) is taken as te.

Here, rotation distance of the photosensitive drum 1 converted from the timings tb, tc, td and te on the basis of the timing to when the rotation of the photosensitive drum 1 is started are taken as rb, rc, rd and re, respectively. Further, a rotation distance of the photosensitive drum 1 at the moment when the image forming apparatus is stopped due to the emergency is taken as rs.

Figure 12:
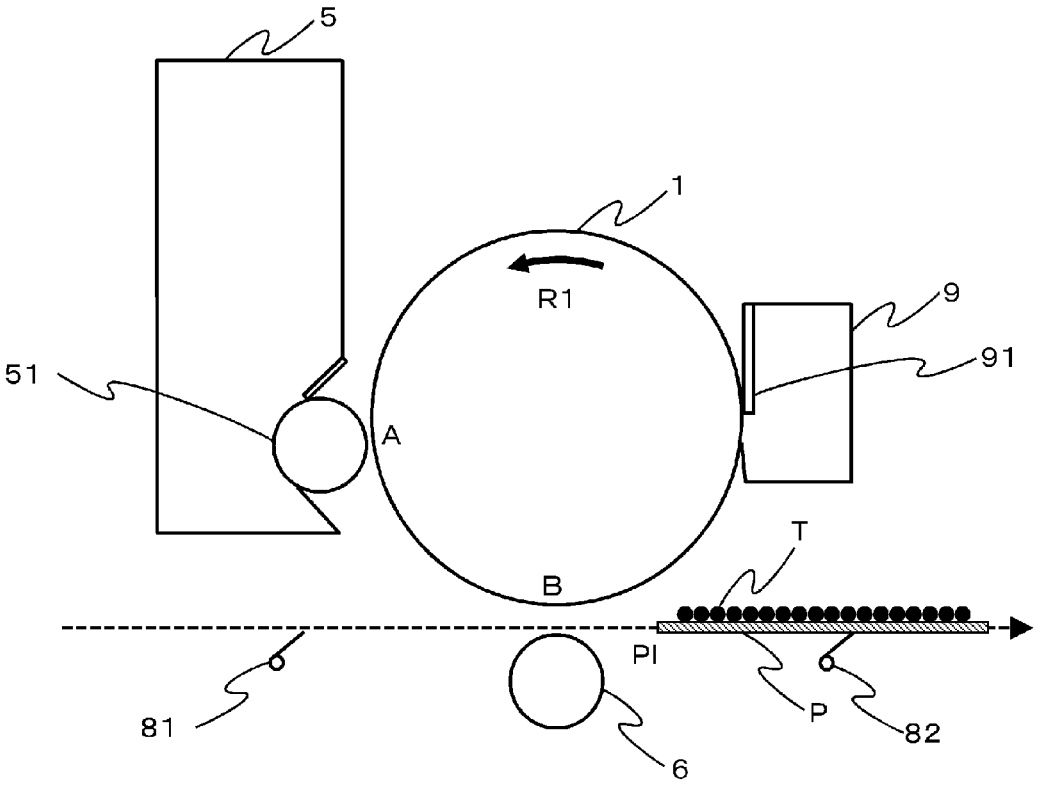
FIG. 12 is a schematic view showing the toner presence state after end of transfer of a toner image onto the recording material.

In the case where the emergency stop is made at the development start time and later and before the transfer end time, i.e., in the case of re≥rs≥rb, the toner remains on the photosensitive drum 1 between the developing position A and the transfer position B with respect to the rotational direction of the photosensitive drum 1. This is because in the case of re≥rs≥rb, the supply of the toner to the photosensitive drum 1 is started and the transfer of the toner is not ended. On the other hand, in the case where the emergency stop is made, i.e., in the case of rb>rs, the toner does not remain on the photosensitive drum 1. Further, also in the case where the emergency stop is made after the end of the transfer, i.e., in the case of rs>re, the toner does not remain on the photosensitive drum 1. Specifically, e.g., as shown in FIG. 12, in the case where the image forming apparatus is stopped due to the emergency after the trailing end P1 of the recording material P passes through the transfer position B and then all the toner image is completely transferred onto the recording material P, the toner in a large amount is not present on the photosensitive drum 1. In such a case, even when the above-described cleaning sequence is not performed, the image defect due to the slip-through of the toner is not generated.

Therefore, this embodiment is characterized in that the toner cleaning sequence is performed only in the case where the rotation distance rs of the photosensitive drum 1 satisfies re≥rs≥rb during execution of the restoring operation after the image forming apparatus is stopped due to the emergency. In other words, the above-described cleaning sequence is performed in the case where the timing when the stop of the image forming operation is detected after the start of the image forming operation is the timing, when the development by the developing device is started, and later and before the timing when the transfer by the transfer roller 6 is ended. Incidentally, the image forming apparatus in this embodiment includes an obtaining means (not shown) for obtaining a time from the start of the image forming operation to the detection of the stop of the image forming operation by the stop detecting means. Further, the image forming apparatus in this embodiment includes a storing means for storing the development start time and the transfer end time in advance. Incidentally, in the above, the detection of the presence of the toner remaining on the photosensitive drum 1 is made on the basis of the movement distance of the photosensitive drum 1, but may also be made on the basis of count of a rotation distance or time of the transfer roller 6, a rotation distance or time of a driving motor (not shown) or the like provided in the image forming apparatus, and the like.

Further, even in the case where the rotation distance rs of the photosensitive drum 1 satisfy re≥rs≥rb, when the electrostatic latent image is not formed on the photosensitive drum 1, the toner is not supplied from the developing device 5 to the photosensitive drum 1, so that the toner in the large amount is not present on the photosensitive drum 1. This is because the toner is deposited in a region where the electrostatic latent image is formed and thus no toner is deposited in a region where the electrostatic latent image is not formed. Therefore, history of a pattern of the electrostatic latent image formed by the exposure device 3 during the image formation is stored in a latent image storing means (not shown). Then, in the case where the pattern of the electrostatic latent image stored in the latent image storing means is such that the electrostatic latent image is formed between the developing position A to the transfer position B on the photosensitive drum 1 during emergency stop of the image forming apparatus, the presence of the toner between the developing position A and the transfer position B is detected. Further, only in the case where the developer detecting means detects the presence of the toner between the developing position A and the transfer position B in such a manner, the above-described cleaning sequence may be performed.

As described above, in Embodiment 1, by performing the cleaning sequence only in the case where the toner is present on the photosensitive drum 1 between the developing position A and the transfer position B with respect to the rotational direction of the photosensitive drum 1, it is possible to reduce a time of the restoring operation.

Embodiment 2

Figure 13:
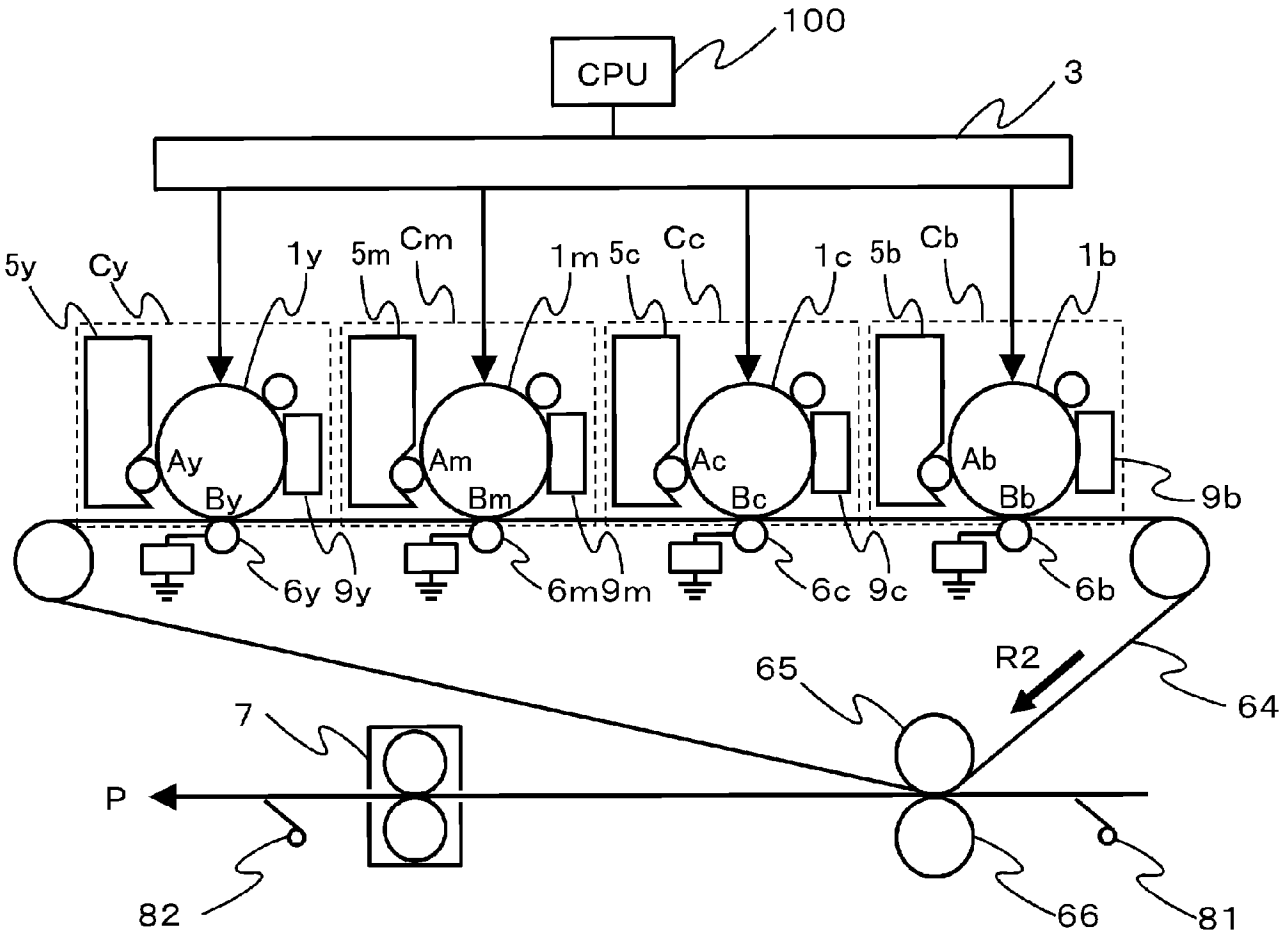
FIG. 13 is a schematic view showing a structure of an image forming apparatus in Embodiments 2 and 3.

In Embodiment 1, the case of a monochromatic image forming apparatus was described, but in this embodiment, as shown in FIG. 13, the case of a four-color based full-color image forming apparatus will be descried. FIG. 13 is a schematic sectional view of a structure of the image forming apparatus in this embodiment.

As shown in FIG. 13, the image forming apparatus in this embodiment includes process cartridge Cy, Cm, Cc and Cb, which are detachably mountable to the image forming apparatus and which incorporate therein toners of yellow (y), magenta (m), cyan (c) and black (b), respectively. The respective process cartridges ((Cy to Cb) include photosensitive drums 1*y* to 1*b*, charging rollers 2*y* to 2*b*, developing devices 5*y* to 5*b* and cleaning devices 9*y* to 9*b*, respectively. Further, the image forming apparatus in this embodiment includes an intermediary transfer belt 64 as an intermediary transfer member provided so as to be capable of being circulated and moved in an arrow R2 direction of FIG. 13. Further, via the intermediary transfer belt 64, primary transfer rollers (transfer means) 6*y* to 6*b* are provided opposed to the photosensitive drums 1*y* to 1*b*, respectively. Incidentally, members identical to those in Embodiment 1 are represented by the same reference numerals or symbols and will be omitted from illustration.

Here, a summary of an image forming operation in this embodiment will be described. For example, in the process cartridge Cy, the photosensitive drum 1*y* is exposed to a laser beam emitted from the exposure device 3, so that an electrostatic latent image is formed. Thereafter, the yellow toner is supplied to the photosensitive drum 1*y* by the developing device 5*y* in which the yellow toner is incorporated, so that the electrostatic latent image is developed to form a yellow toner image (developer image). Then, by the primary transfer roller 6*y*, the yellow toner image is primary-transferred onto the intermediary transfer belt 64. Also in the process cartridges Cm, Cc and Cb, similarly, the respective color toner images are formed and then are successively primary-transferred superposedly onto the intermediary transfer belt (intermediary transfer member) 64 by the primary transfer rollers 6*m*, 6*c* and 6*b*. Here, on the intermediary transfer belt 64, positions in which the primary transfer is made are referred to as primary transfer positions By to Bb, respectively.

The toner images primary-transferred onto the intermediary transfer belt 64 are conveyed by the circulating movement of the intermediary transfer belt 64 to a secondary transfer position where secondary transfer is made by a secondary transfer roller 65 and a secondary transfer opposite roller 66, so that the toner images are secondary-transferred onto the recording material P. Thereafter, the recording material P on which the toner images are secondary-transferred is conveyed to a fixing device 7, in which the toner images are fixed on the recording material P under application of heat and pressure.

Here, in this embodiment, when the image forming operation is stopped due to the emergency in midstream, e.g., the yellow toner is present on (remains on) the photosensitive drum 1*y* (first image bearing member). In such a case, a restoring operation in which the toner on the photosensitive drum 1*y* is conveyed to and removed by a cleaning blade 91*y* as a cleaning means by rotating the photosensitive drum 1*y* has been known. In such a restoring operation, in the case where all of the yellow toner remaining on the photosensitive drum 1*y* is conveyed at once to the cleaning blade 1*y*, the image density non-uniformity due to the slip-through of the toner can occur.

Therefore, a cleaning sequence in which a part or all of the toner remaining on the photosensitive drum 1 (first image bearing member) is once transferred onto the intermediary transfer belt 64 and then is further transferred onto a photosensitive drum 1 (second image bearing member) provided downstream of the photosensitive drum 1 (first image bearing member) with respect to the circulating movement direction of the intermediary transfer belt 64 has been known. By performing such a cleaning sequence in the restoring operation, the amount of the toner conveyed at once to the cleaning blade 91*y* can be reduced, so that the degree of the slip-through of the toner can be decreased. The movement (transfer) between the photosensitive drum 1 and the intermediary transfer belt 64 is made by controlling a voltage to be applied to the primary transfer roller 6 by a voltage application means.

Specifically, in the case where the amount of the toner remaining on the photosensitive drum 1*y* during emergency stop when a solid toner image is formed is 100%, the toner is once transferred onto the intermediary transfer belt 64, and then the toner in the amount of 50% is transferred onto the photosensitive drum 1*m* and the toner in the amount of remaining 50% is transferred onto the photosensitive drum 1*c*. Incidentally, as a method for transferring a part of the toner onto the intermediary transfer belt 64, similarly as in Embodiment 1, a method in which control is effected on the basis of a magnitude of the transfer bias to be applied to the primary transfer roller 6 and a method in which a transfer bias of an opposite polarity is finely applied alternately may also be used.

However, also in a constitution in this embodiment, similarly as in Embodiment 1, in the case where the toner in the large amount is not present on the photosensitive drum 1, there is no need to perform the above-described cleaning sequence. Therefore, the image forming apparatus in this embodiment includes a developer detecting means (not shown) for detecting the presence of the toner between the developing position A and the transfer position B with respect to the rotational direction of the photosensitive drum 1 when the stop detecting means detects the stop of the image forming operation. Further, only in the case where the developer detecting means detects the presence of the toner between the developing position A and the transfer position B with respect to the rotational direction of the photosensitive drum 1, the above-described cleaning sequence is executed.

Incidentally, in this embodiment, the stop detecting means includes the registration sensor 81 and the outer sheet discharging sensor 82 (FIG. 13) similarly as in Embodiment 1. Further, the developer detecting means is provided in the controller 100 provided in the image forming apparatus.

Specifically, in this embodiment, only in the case where timing when stop of the image forming operation is detected after from start of the image forming operation is the development start time, when the development of the electrostatic latent image on the photosensitive drum 1 by the developing device is started, and later and is before the primary transfer end time, the above-described cleaning sequence is performed. As a result, it is possible to reduce the time of the restoring operation after the emergency stop.

Incidentally, the image forming apparatus in this embodiment includes a storing means for storing the development start time and the primary transfer end time in advance. Further, the detection of the presence of the toner on the photosensitive drums 1*y* to 1*b* may also be made on the basis of a rotation distance of the intermediary transfer belt 64 or the like or may also be made, similarly as in Embodiment 1, on the basis of a latent image pattern storing in the latent image storing means.

Embodiment 3

In Embodiments 1 and 2, the case where the toner is present on (remains on) the photosensitive drum 1 when the image forming apparatus is stopped due to the emergency was described. On the other hand, in this embodiment, the case where the toner remains on the intermediary transfer belt 64 as the intermediary transfer member (collecting member) when the image forming operation is stopped due to the emergency is described. Incidentally, in this embodiment, a general structure of the image forming apparatus is the same as that in Embodiment 2, and therefore will be omitted from description (FIG. 13).

In a conventional constitution, the restoring operation in which the toner present on the intermediary transfer belt 64 during emergency stop of the image forming operation is transferred onto the photosensitive drum 1 in the primary transfer position B and then the transferred toner is removed by the cleaning blade 91 by rotating the photosensitive drum 1 has been known. Specifically, by controlling the transfer bias to be applied to the primary transfer roller 6, the toner present on the intermediary transfer belt 64 is transferred onto the intermediary transfer belt 64 in the primary transfer position B. Thereafter, the photosensitive drum 1 is rotated to convey the transferred toner to the cleaning blade 91, and then is removed by the cleaning blade 91.

In the case where the toner in the large amount remained on the intermediary transfer belt 64 during emergency stop, the toner in the large amount was conveyed at once to the cleaning blade 91, so that there was the case where the image density non-uniformity due to the slip-through of the toner was generated. Therefore, it is possible to decrease the degree of the slip-through of the toner by performing the cleaning sequence in which a part of the toner remaining on the intermediary transfer belt 64 during emergency stop is transferred onto any one of the photosensitive drums 1 and for transferring a remaining part of the toner onto another photosensitive drum 1.

Specifically, e.g., in the case where the toner remains on the intermediary transfer belt 64, during emergency stop of the image forming operation, between a primary transfer position By and a primary transfer position Bm, a part of the toner is transferred onto the photosensitive drum 1*m* in the primary transfer position By. Then, the untransferred toner is transferred onto the photosensitive drum 1*c* when the untransferred toner reaches a subsequent primary transfer position at the earliest by the circulating movement of the intermediary transfer belt 64, i.e., when the untransferred toner reaches the primary transfer position Bm However, in the case where the toner in the large amount is not present on the intermediary transfer belt 64 during emergency stop of the image forming operation, there is no need to perform the above-described cleaning sequence. Therefore, the image forming apparatus in this embodiment includes a storing means for storing, in advance, a primary transfer start time, from the start of the image formation to the start of the primary transfer, and a secondary transfer end time until the secondary transfer is ended. Further, the image forming apparatus includes, in the controller 100, a developer detecting means for detecting the presence of the toner on the intermediary transfer belt 64 when the stop detecting means detects the stop of the image forming operation. Further, only in the case where the developer detecting means detects the presence of the toner on the intermediary transfer belt 64, the above-described cleaning sequence is executed.

Specifically, in the case where the time from the start of the image forming operation to the stop of the image forming operation is the primary transfer start time and later and before the secondary transfer end time, the presence of the toner on the intermediary transfer belt 64 is detected.

Incidentally, in this embodiment, as a method for transferring a part of the toner onto the photosensitive drums 1*y* to 1*b*, a method in which control is effected on the basis of a magnitude of the transfer bias to be applied to the primary transfer roller 6 and a method in which a transfer bias of an opposite polarity is finely applied alternately may also be used.

Further, the detection of the presence of the toner on the intermediary transfer belt 64 may also be made on the basis of a rotation time or distance of the photosensitive drums 1*y* to 1*b* and the intermediary transfer belt 64 or may also be made on the basis of a latent image pattern.

According to the present invention, in the image forming apparatus in which the cleaning sequence is performed, it is possible to reduce the restoring time of the restoring operation after the stop of the image forming operation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 242102/2012 and 219954/2013 filed Nov. 1, 2012 and Oct. 23, 2013, respectively, which are hereby incorporated by reference.

What is claimed is:

1. An image forming apparatus comprising:

at least one image bearing member;

a developing device for forming a developer image by developing a latent image formed on a surface of said image bearing member;

a cleaning device, including a cleaning blade which is in contact with said image bearing member and which has elasticity, for collecting a developer on said image bearing member;

discriminating means for discriminating whether or not a cleaning sequence in which an amount of the developer to be conveyed to said cleaning device is adjusted is to be performed; and stop detecting means for detecting stop of an operation of said image forming apparatus, wherein when the operation of said image forming apparatus is resumed after said stop detecting means detects the stop of the operation of said image forming apparatus, said discriminating means discriminates, before said image bearing member is operated, whether or not the cleaning sequence is to be performed.

2. An image forming apparatus according to claim 1, further comprising a collecting member provided downstream of said developing device and upstream of said cleaning device with respect to a rotational direction of said image bearing member, wherein said collecting member is rotatably contactable to said image bearing member so as to be capable of collecting the developer, and wherein the cleaning sequence is performed by collecting at least a part of the developer on said image bearing member by said collecting member and then by returning the collected developer to said image bearing member.

3. An image forming apparatus according to claim 2, further comprising voltage application means for applying a voltage to said collecting member, wherein the cleaning sequence is performed by collecting at least a part of the developer on said image bearing member by said collecting member and then by applying the voltage to said collecting member that the collected developer is returned to the image bearing member.

4. An image forming apparatus according to claim 2, wherein said collecting member is transfer means for nip-conveying a recording material and for transferring the developer image onto the recording material by being pressed toward said image bearing member.

5. An image forming apparatus according to claim 4, further comprising:

string means for storing, in advance, a development start time from start the operation of said image forming apparatus to start of development by said developing device and a transfer end time from start of transfer of the developer image onto the recording material to end of the transfer, and obtaining means for obtaining a time from the start of the operation of said image forming apparatus to detection of the stop of the operation of said image forming apparatus by said stop detecting means, wherein when the time obtained by said obtaining means is the development start time or later and before the transfer end time, the cleaning sequence is performed.

6. An image forming apparatus according to claim 4, further comprising latent image storing means for storing a pattern of the latent image, wherein the cleaning sequence is performed when the pattern of the latent image stored by said latent image forming means is such that the latent image is formed, on said image bearing member when said stop detecting means detects the stop of the operation of said image bearing member, between a developing position where the developer is supplied by said developing device and a transfer position where the developer image is transferred onto the recording material by said transfer means, with respect to the rotational direction of said image bearing member.

7. An image forming apparatus according to claim 1, further comprising:

an intermediary transfer member provided so as to be capable of being circulated and moved;

primary transfer means, provided opposed to said image bearing member via said intermediary transfer member, for primary-transferring the developer image from said image bearing member onto said intermediary transfer member; and secondary transfer means for secondary-transferring the primary-transferred developer image onto the recording material.

8. An image forming apparatus according to claim 7, further comprising a second image bearing member provided downstream of said image bearing member with respect to a circulating movement direction of said intermediary transfer member, wherein the cleaning sequence is performed by collecting at least a part of the developer on said image bearing member by said intermediary transfer member and then by returning the collected developer to said second image bearing member.

9. An image forming apparatus according to claim 7, further comprising:

string means for storing, in advance, a development start time from start the operation of said image forming apparatus to start of development by said developing device and a primary transfer end time from start of primary transfer of the developer image onto said intermediary transfer member by said primary transfer means to end of the primary transfer, and obtaining means for obtaining a time from the start of the operation of said image forming apparatus to detection of the stop of the operation of said image forming apparatus by said stop detecting means, wherein when the time obtained by said obtaining means is the development start time or later and before the primary transfer end time, the cleaning sequence is performed.

10. An image forming apparatus according to claim 7, further comprising latent image storing means for storing a pattern of the latent image, wherein the cleaning sequence is performed when the pattern of the latent image stored by said latent image forming means is such that the latent image is formed, on said image bearing member when said stop detecting means detects the stop of the operation of said image bearing member, between a developing position where the developer is supplied by said developing device and a primary transfer position where the developer image is primary-transferred onto said intermediary transfer member by said primary transfer means.

11. An image forming apparatus comprising:

at least one image bearing member;

a developing device for forming a developer image by developing a latent image formed on a surface of said image bearing member;

a cleaning device, including a cleaning blade which is in contact with said image bearing member and which has elasticity, for collecting a developer on said image bearing member;

an intermediary transfer member provided so as to be capable of being circulated and moved;

primary transfer means, provided opposed to said image bearing member via said intermediary transfer member, for primary-transferring the developer image from said image bearing member onto said intermediary transfer member;

secondary transfer means for secondary-transferring the primary-transferred developer image onto the recording material;

discriminating means for discriminating whether or not a cleaning sequence in which an amount of the developer to be conveyed to said cleaning device is adjusted is to be performed; and stop detecting means for detecting stop of an operation of said image forming apparatus, wherein when the operation of said image forming apparatus is resumed after said stop detecting means detects the stop of the operation of said image forming apparatus, said discriminating means discriminates, before said intermediary transfer member is operated, whether or not the cleaning sequence is to be performed.

12. An image forming apparatus according to claim 11, further comprising a second image bearing member provided downstream of said image bearing member with respect to a circulating movement direction of said intermediary transfer member, wherein the cleaning sequence is performed by collecting at least a part of the developer on said intermediary transfer member by said image bearing member and then by collecting the developer, which is not collected, by said second image bearing member.

13. An image forming apparatus according to claim 11, further comprising:

string means for storing, in advance, a primary transfer start time from start the operation of said image forming apparatus to start of primary transfer of the developer image onto said intermediary transfer member by said primary transfer means and a secondary transfer end time from start of secondary transfer of the developer image onto the recording material by said secondary transfer means to end of the secondary transfer, and obtaining means for obtaining a time from the start of the operation of said image forming apparatus to detection of the stop of the operation of said image forming apparatus by said stop detecting means, wherein when the time obtained by said obtaining means is the primary transfer start time or later and before the secondary transfer end time, the cleaning sequence is performed.

14. An image forming apparatus according to claim 11, further comprising latent image storing means for storing a pattern of the latent image, wherein the cleaning sequence is performed when the developer image formed on the basis of the pattern of the latent image stored by said latent image forming means is formed, on said image bearing member when said stop detecting means detects the stop of the operation of said image bearing member, between a primary transfer position where the developer image is primary-transferred onto said intermediary transfer member by said primary transfer means and a secondary transfer position where the developer image is secondary-transferred onto the recording material by said secondary transfer means.

* * * * *